United States Patent [19]

Becka

[11] Patent Number: 4,490,868

[45] Date of Patent: Jan. 1, 1985

[54] COMPOSITE BAND FOR A FOOTWEAR-FORMING MACHINE

[75] Inventor: Michael M. Becka, Nashua, N.H.

[73] Assignee: International Shoe Machine Corporation, Nashua, N.H.

[21] Appl. No.: 535,090

[22] Filed: Sep. 23, 1983

[51] Int. Cl.[3] ..... A43D 23/02; A43D 23/00

[52] U.S. Cl. ..... 12/14.4; 12/14.3

[58] Field of Search ..... 12/14.3, 14.4, 8.2, 12/10.5

[56] References Cited

U.S. PATENT DOCUMENTS

| | | | |
|---|---|---|---|
| 1,306,247 | 6/1919 | Brock | 12/14.4 |
| 1,516,485 | 11/1924 | Adams | 12/14.4 |
| 2,013,057 | 9/1935 | Lane et al. | 12/14.3 |
| 2,479,574 | 8/1949 | Jorgensen | 12/14.4 |
| 3,606,625 | 9/1971 | Ioannilli | 12/14.4 |
| 3,689,952 | 9/1972 | Dawson et al. | 12/14.4 |
| 4,246,673 | 1/1981 | Fichtner | 12/14.4 |

FOREIGN PATENT DOCUMENTS

| | | | |
|---|---|---|---|
| 1,285,559 | 8/1972 | United Kingdom | 12/14.4 |
| 1333202 | 10/1973 | United Kingdom | 12/14.4 |

*Primary Examiner*—Werner H. Schroeder
*Assistant Examiner*—Steven N. Meyers
*Attorney, Agent, or Firm*—Robert Shaw

[57] ABSTRACT

A composite band for use in a footwear-forming machine. The composite band includes an elongated pad formed to have a bight portion and a pair of legs extending outwardly from the bight portion. A flexible elongated metal is secured at the outer surface of the elongated pad. The composite band is subjected to flexing forces whereby, in the footwear forming process, it is repeatedly bent to conform to the shape of the footwear and then relaxed to an unflexed condition. The metal strip contains three (or more) spaced loops, one at each leg and one at the bight portion, to prevent undue stress during flexure. The loops serve also to permit inwardly-directed forces to be applied to the composite band.

9 Claims, 3 Drawing Figures

COMPOSITE BAND FOR A FOOTWEAR-FORMING MACHINE

The present invention relates to bands that are used in footwear forming machines.

Attention is called to U.S. Pat. Nos. 2,234,509 (Jorgenson); 3,115,650 (Kamborian); 3,228,046 (Kamborian et al); 3,606,625 (Ioannilli); and 4,246,673 (Fichtner).

In the description, to simplify the explanation, the invention is described in the context of a lasting machine for shoes, the emphasis being on the toe-lasting process; but the composite band can be employed in other contexts, e.g., the Kamborian U.S. Pat. No. 3,115,650. In the toe-lasting process, an assembly consisting of a shoe upper draped over a last and an inner sole at the last bottom is placed (bottom down) upon the footrest of a toe-lasting machine; the upper is drawn tightly about the last; and a band of the type herein disclosed is forced into tight contact with the toe end and ball portions of the upper to retain the upper in position during wiping. As is known in this art, stretching of the upper is achieved by pincers which draw the leather (or other) upper about the last but which must be removed to permit wiping. The function of the band is to press tightly against the side of the shoe upper immediatlely adjacent to the margin to maintain the upper in position and under tension once the pincers have disengaged. For purposes later discussed, bands for this purpose are composite bands of steel and, usually, a plastic material such as Teflon. In the course of repeated flexure it has been found that the steel portion fractures.

Accordingly, it is an object of the present invention to provide a composite band wherein the effects of repeated flexure are mitigated.

Another object is to provide a flexure-relieving mechanism that permits facile and effective interface with the lasting machine.

These and still further objects are addressed hereinafter.

The foregoing objects are achieved, generally, in a novel composite band for use in a lasting machine or the like which receives a footwear assembly comprising a footwear upper draped over a last and an inner sole at the last bottom. The composite band is wrapped about a curvilinear portion of the assembly during lasting. The composite band includes a plastic (or other) elongate pad having a bight portion and a pair of legs extending outwardly from the bight portion (the pad is essentially V-shaped except that the apex of the V is rounded to form a bight). A metal strip is secured at the outer surface of the pad whose inner surface presses against the assembly during the lasting process. The strip is deformed to include a plurality of at least three loops; the loops are spaced from one another along the strip, one being disposed on each leg of the strip and one at the bight portion thereof. The composite pad is subjected to repeated flexing forces during lasting to cause it to conform to the contour of the curvilinear portion of the assembly to retain the upper in position during a wiping operation. The plurality of loops serve to relieve stresses in the metal strip during repeated flexure.

The invention is hereinafter described with reference to the accompanying drawing in which.

Figure 1:
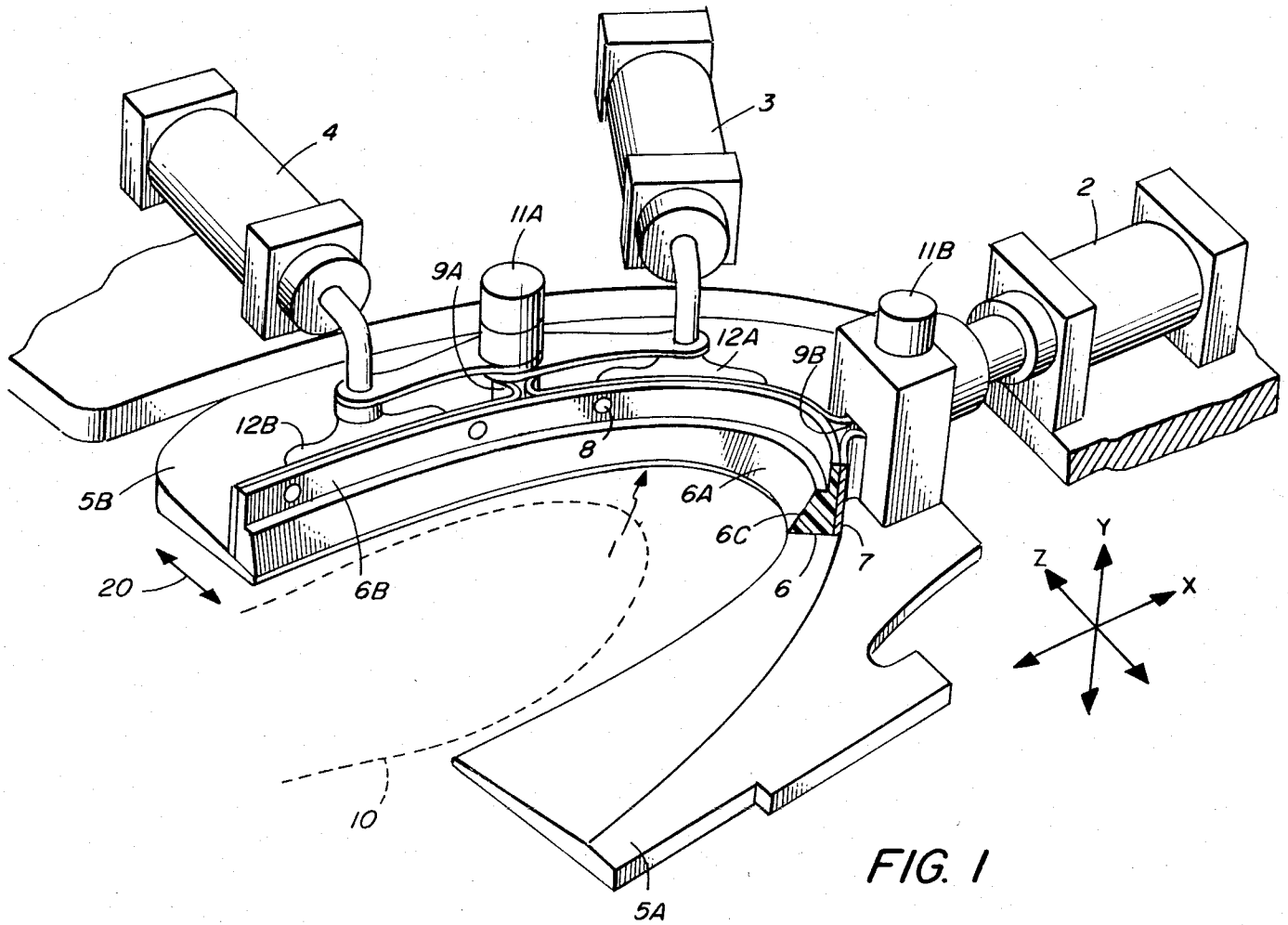
FIG. 1 is an isometric section, partial view of a preferred embodiment of a composite band of the present invention and showing closely-related parts of a shoe machine in which the composite band is installed.
Figure 2:
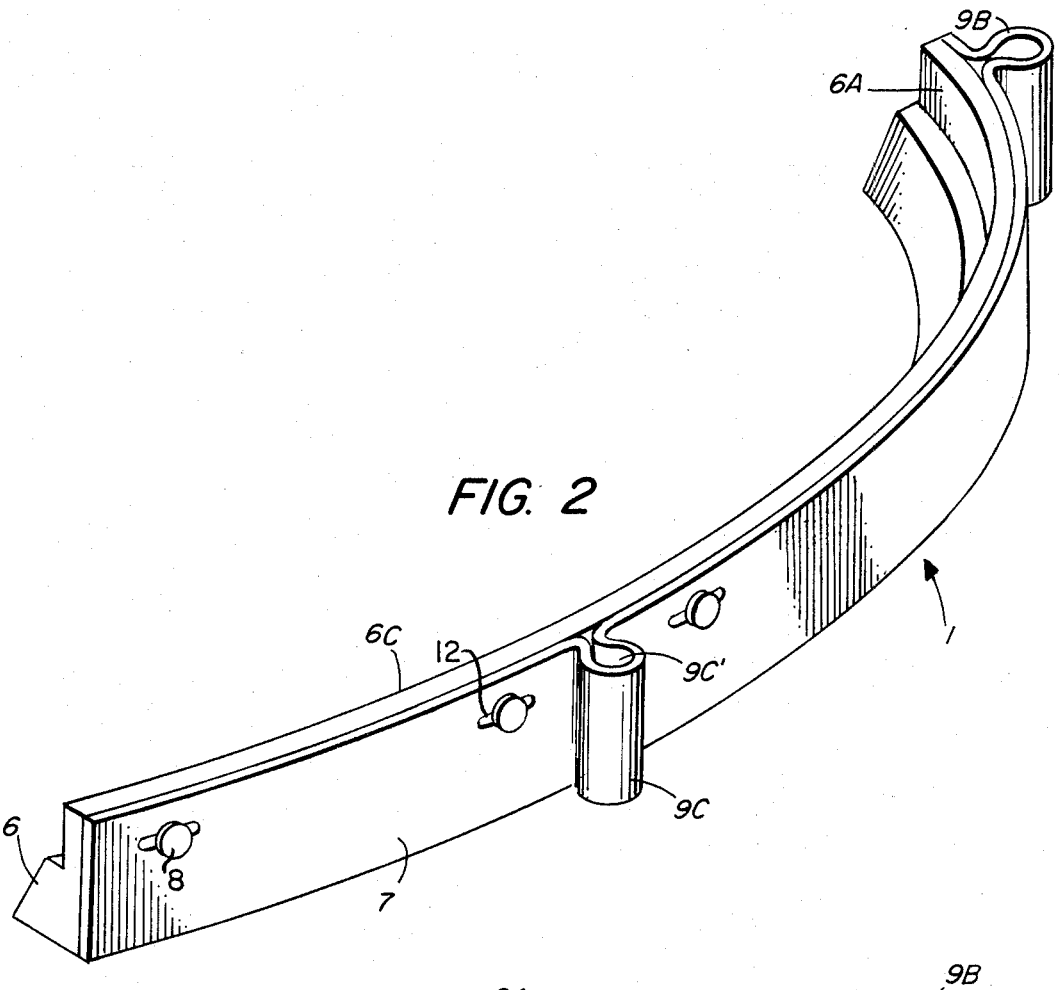
FIG. 2 is an isometric view, slightly enlarged, of the right portion of the composite band whose left portion is shown in FIG. 1.

To place the invention in the context of a shoe machine, the composite band labeled 1 in FIGS. 1 and 2 is shown in FIG. 1 with closely associated shoe machine parts. Briefly, in the typical lasting process, the shoe upper assembly shown in broken line form at 10 in FIG. 1 is placed bottom down on a footrest (not shown); pincers (also not shown) stretch the upper tightly upon a last. At that juncture, the band 1 is moved in the minus x direction in FIG. 1 to engage the toe-end of the assembly 10 by an air cylinder 2 while two air cylinders 3 and 4 move the composite band into engagement with the side and ball portions of the assembly 10; further similar air cylinders (not shown) move the other leg (i.e., 6C in FIG. 2) of the composite band into tight engagement with the other side of the assembly 10. Then, typically, the pincers release (or reduce) their grip of the upper margin, and wipers 5A and 5B wipe the margin of the shoe upper against the shoe inner sole (as is well known) while the shoe upper is held firmly in place by the composite band 1.

The function of the band 1 is, thus, to wrap about the curvilinear portion of the assembly 10 (which includes a shoe upper draped over a last and an inner sole at its bottom) during the wiping process. The band 1 includes an elastic footwear engaging member 6 (e.g., an elongated Teflon, i.e., polytetrafluoroethylene, preformed to the modified V-shaped configuration shown) having a bight portion 6A and a pair of legs 6B and 6C extending outwardly from the bight portion 6A. An elongated flexible metal strip 7 is secured at the outer surface of the member 6 by rivets 8 which extend through elongated apertures 12 (FIG. 2) and through the member 6. The metal strip 7 has a series of at least three loops 9A, 9B and 9C spaced from one another along the strip, the loop 9A being located on the leg 6B, the loop 9C being located on the leg 6C and the loop 9B being located at the bight portion 6A. The loops are circular-cylindrical with the cylinder axis parallel to the side of the strip 7 and perpendicular to the longitudinal axis of the stip 7. The band 1 is subjected to forces during the shoe forming process by the cylinders 3, 4, etc., as indicated by the arrow labeled 20 to cause it to conform to the curvilinear portion of each shoe upper assembly to retain the upper position during the wiping operation. The loops 9A, 9B, etc., serve to relieve stress (and breakage) that otherwise would occur in the strip 7 during repeated bending of the legs 6B and 6C by the cylinders 3, 4, etc.

The loops 9A–9C serve (in addition to the stress-relieving function) to provide pivotal attachment of the air cylinders. The designation 11A and 11B indicate knurled knobs that have cylindrical rod ends (not shown) that are received by the circular openings (e.g., 9C' in FIG. 2) in the loops thereby permitting pivoting between the force-providing rods and the associated loop during movement of the composite band 1 into tight engagement with the assembly 10.

Forces from the air cylinders 3, 4 etc., are transmitted by metal pads 12A, 12B etc., and thence to the strip 7 which then transmits relatively uniform, inwardly-directed forces to the Teflon pad 6. Thus, while the strip 7 must be sufficiently flexible to permit bending about the smallest sharp curves in the upper 10, it must be sufficiently rigid to transmit forces from the metal pads 12A, 12B, etc., somewhat uniformly to the Teflon (or other) pad 6.

Figure 3:
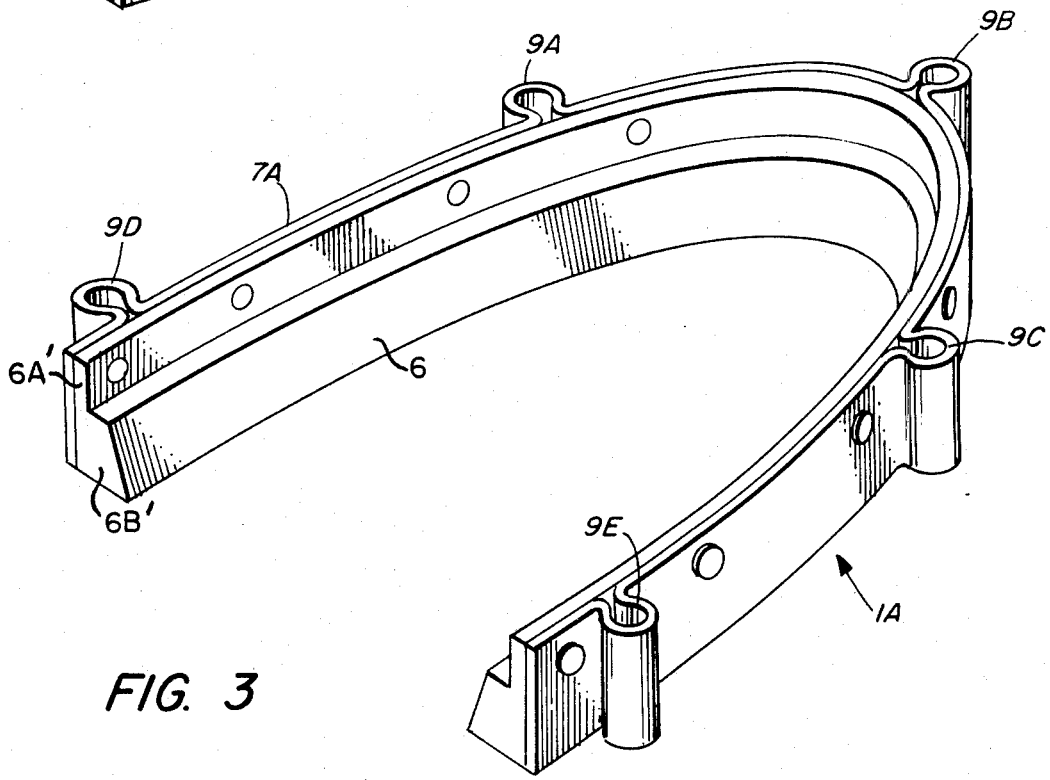
FIG. 3 is an isometric view of a modification of the band of FIG. 1.

The composite band marked 1A in FIG. 3 includes a metal strip 7A with two additional loops 9D and 9E respectively to receive inwardly-directed forces from the cylinder 4 in FIG. 1 and another cylinder not shown in the figures, to permit outward forces to help the spring-steel strip 7A open following wiping. It will be appreciated that speed of action is of importance in the lasting process which involves multiple flexures of the bands 1 and 1A every minute.

While the preferred form of the pad 6 is Teflon, other plastic materials and leather may be used as well. The pad 6 must be made of a material that will not mark the shoe upper. The strip 7 serves to apply somewhat uniform inwardly-directed forces to retain the shoe upper during wiping. The strip 7 in FIG. 2 has elongated or elliptical-shaped holes 12 to permit slight longitudinal movement of the strip relative to the Teflon pad 6 to provide a further stress relieving function during flexure.

Both the band 1 and the band 1A have Teflon pads 6 that are stepped, i.e., the pad 6 in FIG. 3, for example, has a step 6B' (or step portion) that extends inward from a riser (or riser portion) 6A'. The riser 6A' is riveted to the metal strip 7, but it is the step 6B that engages the upper. In this way, the rivets are kept from contact with the upper during wiping.

Further modifications of the present invention will occur to persons skilled in the art and all such modifications are deemed to be within the scope of the invention as defined by the appended claims.

What is claimed is:

1. For use in a footwear-forming machine a composite band for wrapping about a curvilinear portion of a footwear upper assembly comprising a footwear upper draped over a last and an innersole, that comprises:

an elastic footwear engaging member having a bight portion and a pair of legs extending outwardly from the bight portion; and an elongated flexible metal strip secured at the outer surface of the footwear engaging member, said metal strip being deformed to form a series of at least three loops therein, which loops are spaced from one another along the elongate metal strip, at least one being located on each leg and the third at the bight portion of the footwear engaging member, each said loop being cylindrical with the cylinder axis parallel to the side of the metal strip and perpendicular to the longitudinal axis of the metal strip;

said footwear engaging member being subjected to forces during the footwear forming process that cause it to conform to said curvilinear portion of each footwear upper assembly to retain the upper position during a wiping operation in the forming process, the series of loops serving to relieve stress on the elongated metal strip during deformation.

2. A composite band according to claim 1 in which the footwear engaging member is formed of plastic.

3. A composite band according to claim 2 wherein the footwear engaging member is a Teflon pad.

4. A composite band according to claim 1 wherein the footwear engaging member is formed of leather.

5. A composite band according to claim 1 having five said loops, two on each of the pair of legs and one at said bight portion.

6. A composite band according to claim 1 wherein the loops serve the further function of attachment to the machine.

7. A composite band according to claim 1 wherein said elastic footwear engaging member is a Teflon pad to which the metal strip is attached by rivets, which rivets pass through elliptical-shaped apertures in the strip, said apertures permitting slight longitudinal movement of the strip relative to the Teflon pad to provide a further stress relieving function.

8. In a footwear-forming machine, a composite band as defined by claim 1 and means to engage the composite band by pivotal attachment to said loops.

9. A composite band according to claim 1 in which the footwear engaging member is rivetted to the metal strip and in which the footwear engaging member has a step portion that extends inwardly at an angle from a riser portion, the riser portion being rivetted to the metal strip while the inwardly projecting step portion serves to engage the upper assembly during wiping.

* * * * *